United States Patent [19]

Latassa et al.

[11] Patent Number: 5,004,949

[45] Date of Patent: Apr. 2, 1991

[54] FLUORESCENT LAMP WITH GROUNDED ELECTRODE GUARD

[75] Inventors: Frank M. Latassa, Morgantown; Thomas O. Leyh, Bridgeport, both of W. Va.

[73] Assignee: North American Philips Corporation, New York, N.Y.

[21] Appl. No.: 456,027

[22] Filed: Dec. 22, 1989

Related U.S. Application Data

[63] Continuation-in-part of Ser. No. 200,382, May 31, 1988, Pat. No. 4,891,551.

[51] Int. Cl.[5] ..... H01J 61/10

[52] U.S. Cl. ..... 313/492; 313/151; 313/614; 313/240

[58] Field of Search ..... 313/492, 574, 595, 609, 313/613, 614, 239, 240, 151

[56] References Cited

U.S. PATENT DOCUMENTS 2,938,137 5/1960 Reger et al. ..... 313/492 X 4,891,551 1/1990 Will et al. ..... 313/492

*Primary Examiner*—Kenneth Wieder

*Attorney, Agent, or Firm*—Brian J. Wieghaus

[57] ABSTRACT

A conductive link maintains the electrode of a fluorescent lamp and a conductive electrode guard at the same electrical potential to reduce lamp power dissipation. The conductive link is a bimetal strip arranged for electrically connecting an electrode lead-in with the electrode guard or electrode guard support upon heating by the discharge arc during lamp operation.

6 Claims, 3 Drawing Sheets

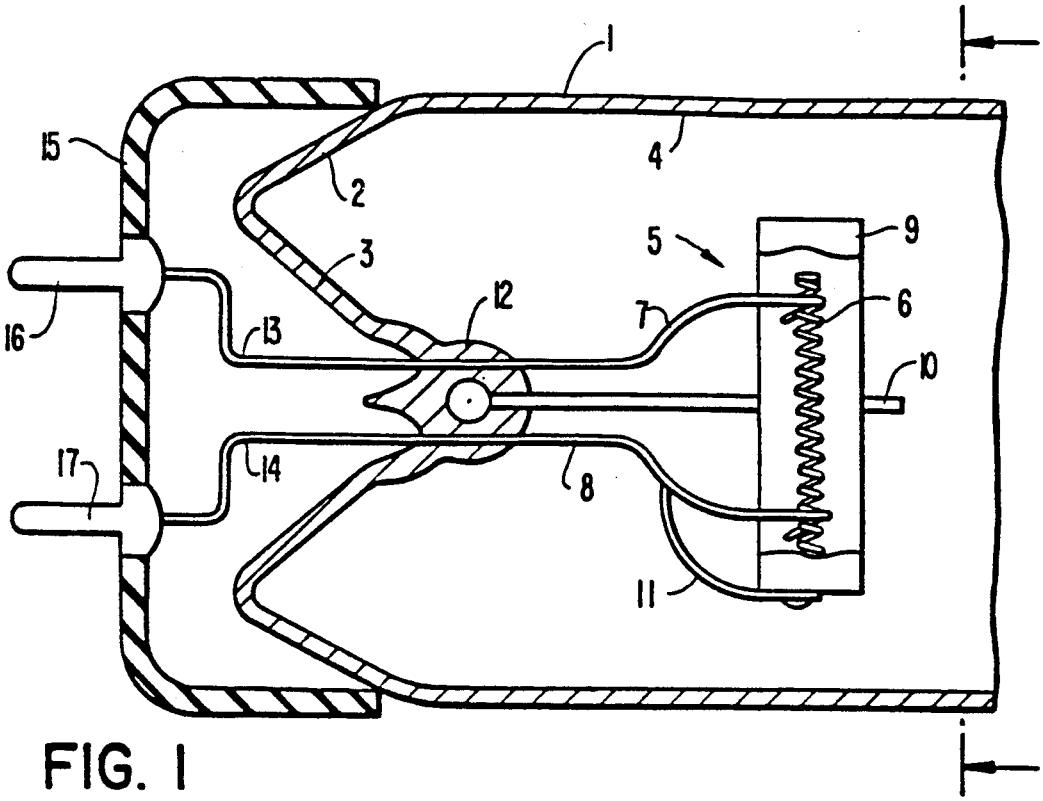
FIG. 1
FIG. 2
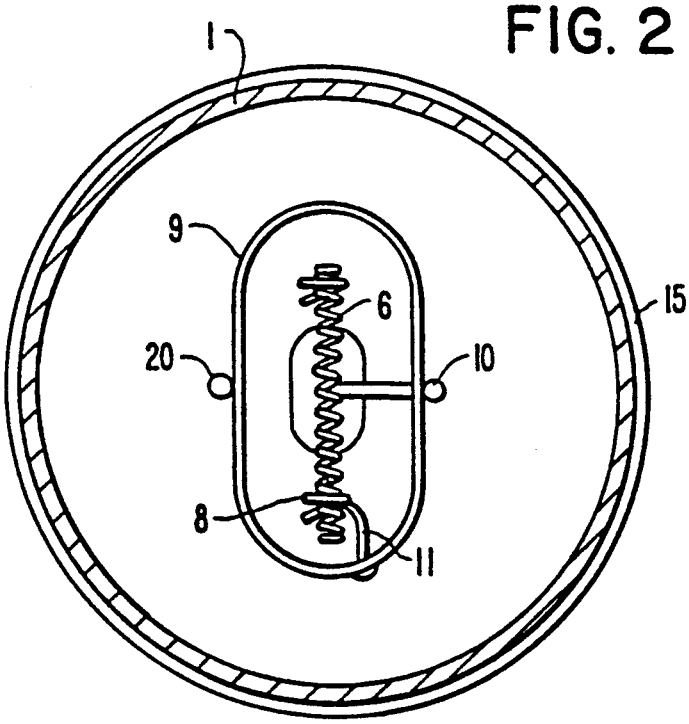

FLUORESCENT LAMP WITH GROUNDED ELECTRODE GUARD

CROSS-REFERENCE TO RELATED APPLICATION

This is a continuation-in-part of U.S. application Ser. No. 07/200,382 filed May 31, 1988, now U.S. Pat. No. 4,891,551.

BACKGROUND OF THE INVENTION

The present invention relates to fluorescent lamps having metallic electrode guards, and more particularly to a safe improvement in such lamps that reduces lamp power dissipation.

Low pressure mercury vapor discharge lamps having a phosphor layer for emitting light, commonly known as fluorescent lamps, generally have electrodes made of coiled tungsten wire. These electrodes are coated with a material for enhancing the thermionic emission of electrons. During lamp operation tungsten and emitter material can evaporate or sputter from the electrodes and be deposited in the area of the electrodes on the lamp wall in the form of tungsten and tungsten products. This deposition is evident as visible blackening and is a detrimental consequence of lamp operation.

One technique for suppressing the blackening from electrode materials is to partially surround each electrode with a guard. The guard is typically in the form of a closed ring made of a conductive metal strip and positioned surrounding the sides of the electrode. Examples of this structure are shown in U.S. Pat. Nos. 4,032,813 and 4,032,814.

In these patents the conductive metal strip carries a getter such as a mixture of zirconium and aluminum for reducing the quantity of unwanted impurity gasses. Additionally, the metal strip supports a small capsule of mercury needed for normal lamp operation. Finally, the conductive metal strip reduces the lamp's energy consumption.

Both of the patents just mentioned show lamp structure in which the electrical potential of the electrode guard is floating relative to the electrode potential. This is achieved by mechanically supporting it on a mount that is electrically insulated from the supports of the electrode. The floating arrangement of the electrode guard is also mentioned in the text Fluorescent Lamps And Lighting, W. Elenbaas, ed., Sec. 5.3 (1962).

In fluorescent lamps that operate on alternating current the electrodes operate alternately as a cathode and an anode. As discussed in the text Electric Discharge Lamps, John Waymouth, Chapter 4 (MIT 1971), the alternating function of the electrodes requires compromises in the electrode design. Ideally, a fluorescent lamp anode electrode would have a large area to reduce the potential difference between the anode and the plasma within the lamp, known as the "anode fall". The large area, however, would be detrimental to cathode operation of the electrode which requires rapid heating to thermionic emitting temperatures and to avoid sputtering during glow discharge.

It would be desirable to use the prior art cathode guard as part of the electrode when the electrode is operating as an anode. This would increase the effective area of the anode and thereby reduce the anode fall; however, care would have to be taken to avoid degrading this cathode operation of the electrode.

A lamp employing an electrode shield as part of the anode is disclosed in German Democratic Republic Patentschrift 221,881. In that patent a cold-starting, self-heating electrode is connected to a cylindrical concentric auxiliary electrode, having the structure of a shield, through a diode. When the electrode is biased positive to operate as the anode, the diode polarity is effective to establish a conductive path between the self-heating electrode and the auxiliary electrode. Consequently, the effective electrode total area includes the auxiliary electrode area and the anode fall is reduced. When the electrode is biased negative, that is, as a cathode, the diode polarity presents a high impedance path to the auxiliary electrode which is effectively disconnected from the self-heating electrode.

It would be desirable to use the same technique in lamps with other types of electrodes. However, there are practical reasons for not doing so. The use of a diode within the lamp discharge envelope presents severe quality requirements for the component. The diode must be able to withstand an intense ultraviolet flux, and elevated temperatures for the life of the lamp which may exceed 20,000 operating hours. The diode also contributes to the lamp cost and consequently the avoidance of using a diode would be advantageous.

Additionally, if a lamp having a filament electrode has an electrode guard electrically connected to one current lead of the electrode, there is a danger that the other electrode lead might come in contact with the electrode guard. This could occur, for example, if the filament electrode broke and a piece attached to the electrode lead that is normally unconnected to the guard were to flop over and touch the guard. The consequence would be a low resistance connection across the electrode leads, rather than the normal electrode impedance, with an excessive current flow through the lamp ballast electrode heater winding. If the lamp remained in this condition for an extended period of time, damage to the ballast could occur.

SUMMARY OF THE INVENTION

Accordingly, it is an object of the invention to provide an electrode assembly in which an electrode guard connected to the lamp electrode can be safely utilized with filament electrodes.

It is another object of the invention to provide an electrode assembly which exhibits a reduced anode fall without the use of rectifying elements or similar components.

It is still another object of the invention to provide an electrode assembly in which the connection between the lamp electrode and the electrode guard can be easily provided during lamp assembly and in a cost effective manner.

In a fluorescent lamp according to the invention a lamp electrode is partially surrounded by a metallic guard for shielding material ejected from the electrode. A metallic conductive link defining a conductive path free of rectifying elements is connected to establish a conductive path between the metallic guard and a conductor supplying voltage to the electrode. The metallic conductive link maintains the metallic guard substantially at the same potential as the electrode, irrespective of the polarity of the electrode voltage.

In a preferred embodiment of the invention the metallic conductive link is a fuse. The metallic conductive link consists essentially of a length of wire connected between the metallic guard or the metallic guard support and a conductor supplying voltage to the electrode. In a preferred embodiment the length of wire is 0.0035 inch diameter stainless steel wire.

In a preferred embodiment the lamp electrode is a filament electrode having respective ends connected to first and second lead-in conductors to allow application of a potential across the electrode. The potential applied across the first and second lead-in conductors causes a heating current to flow through the filament electrode. A metallic guard partially surrounds the electrode, and a metallic fuse link is connected to define a conductive path between the metallic guard and the first lead-in conductor for maintaining the metallic guard at the same potential as the first lead-in conductor during normal lamp operation. The fuse link is effective to fuse and disconnect the metallic guard from the first lead-in conductor in response to an excess current through the fuse link. The metallic fuse link is comprised of a metal wire defining a conductive path free of rectifying elements between the metallic guard and the first lead-in conductor. The metallic fuse link can be connected to the first lead-in conductor and either directly to the metallic guard or to a conductive support for the metallic guard. The connection of the metal wire between the lead-in and either the metallic guard or inductive support is preferably accomplished by spot welding.

However, despite the high level of automation in the manufacture of fluorescent lamps, it has been found in practice that the welding of the metal wire to the electrode lead-in and either the metallic guard or metallic guard support requires hand welding by skilled operators. The automation of the welding of the wire link is not practical because of the location of the welds on two separate parts which do not lie in a common plane, as shown in FIG. 3, and the close proximity of the two welds because of the small size of the electrode assembly, as shown in FIG. 4. To facilitate automation, it would be desirable to provide a conductive link which can be welded at only one point and still provide a reliable electrical connection during lamp operation.

According to another embodiment, the metallic conductive link is a bimetal strip. The bimetal strip is arranged such that upon starting of the lamp, heat from the electrode and the discharge arc within the lamp causes the bimetal strip to bend and electrically connect the electrode lead-in and the metallic guard or conductive guard support. The bimetal is preferably spot welded at one end to either the electrode lead-in or the electrode guard. During lamp operation, heat from the discharge arc keeps the bimetal in contact with the metallic guard and electrode lead-in, maintaining the metallic guard and electrode at the same potential irrespective of polarity of the electrode voltage.

In the preferred embodiment of the lamp having a metallic guard support and first and second lead-in conductors connected to a filament electrode, the bimetal is arranged for making contact between either of the lead-ins and the guard support. The bimetal strip is preferably arranged with one end welded to either of the first or second lead-in conductors and with the opposite free end of the bimetal disposed adjacent to the guard support. The bimetal is oriented such that heat from the discharge arc will cause the free end of the bimetal strip to deflect against the guard support. Thus, electrical contact of the free end of the bimetal with the guard support will automatically occur shortly after the lamp starts.

Use of the bimetal strip in the above fashion may be readily automated since the bimetal strip can be supplied and cut with conventional ribbon feeding machines. Since the free end of the bimetal strip may be located within a large tolerance zone because of the ability of the bimetal to bend to a large extent, precise positioning of the strip is not critical. Additionally, the placement of welding electrodes for spot welding is easier than for a thin wire since the width of the bimetal strip provides a larger area for the weld location.

Short-circuiting caused by a portion of the filament contacting the electrode guard during filament failure is less of a concern than with a wire link. It has been found that the filament electrode will generally fail when the heater current is initially applied to the electrode during starting of the lamp and before the establishment of a discharge arc within the lamp. The bimetal is preferably chosen such that heat from the filament electrode due to the heater current alone is not enough to cause the bimetal to bend and electrically connect the guard support and the electrode lead-in. Thus, if a portion of the filament were to fall against the metallic guard when the heater current is initially applied and before a discharge arc is established, short-circuiting will not occur because their is no electrical path between the guard support and the lead-in to which the bimetal is welded.

BRIEF DESCRIPTION OF THE DRAWINGS

FIG. 1 is a partial section showing an electrode assembly according to the invention in a fluorescent lamp, FIG. 2 is a cross-section of the electrode assembly and lamp shown FIG. 1.

DETAILED DESCRIPTION OF THE INVENTION

Figure 3:
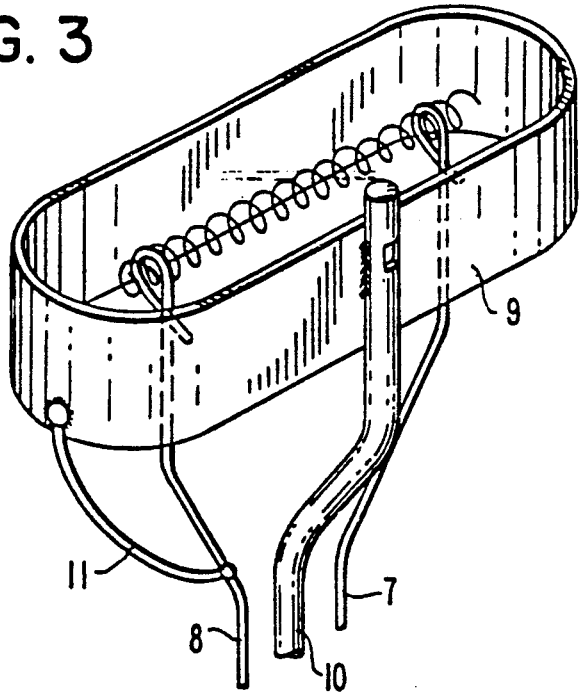
FIG. 3 is an isometric view of the electrode assembly according to the invention.

FIG. 1 illustrates an end portion, in section, of a fluorescent lamp, including the electrode assembly of the lamp. The lamp is comprised of an envelope having a tubular section 1 with a smaller diameter end 2 which is closed by a stem 3. The inner surface for the lamp envelope is coated with a fluorescent material 4 which fluoresces in response to ultraviolet radiation. Electrode assembly 5 within the lamp envelope 1 is energizable for sustaining an electrical discharge through a plasma of mercury atoms within the lamp. The atoms undergo excitation and emit the ultraviolet radiation which is incident on the coating of fluorescent material 4. The fluorescent material 4 fluoresces in the visible region and emits light. These aspects of the lamp are conventional.

The electrode assembly 5 is comprised of a filament electrode 6 supported by a pair of conductive lead-through and supports 7, 8. This structure permits a heater current to flow through the filament electrode 6 during lamp operation and is the type of electrode structure used with rapid-start type lamp ballasts. A short cylindrical guard 9 or shield partially surrounds the filament electrode 6 and is supported on a guard support 10.

A novel feature of the invention is the metallic conductive link 11 connected between the electrode support 8 and the electrode guard 9. The conductive link 11 is connected to the support 8 and the guard 9 so as to define a conductive path between them and maintain them at the same potential during lamp operation, i.e. the guard 9 is grounded to the electrode 6.

The stem 3 terminates at a press seal 12 in which the conductive electrode supports 7, 8 and guard support 10 are embedded. Leads 13, 14 are connected to respective ones of the supports 7, 8 and emerge from the press seal 12. A lamp end cap 15 covers the end 2 of the lamp envelope 1 and carries two lamp pins 16, 17 that are insulated from each other in a conventional manner. The respective leads 13, 14 are connected to pins 16, 17. An external voltage is applied across the pair of pins 16, 17 and is consequently developed across the filament electrode 6 for heating the electrode and operating the lamp.

A cross-section of the structure shown in FIG. 1 is illustrated in FIG. 2. A mercury-containing capsule 20 is mounted on a side of the guard 9 opposite the filament electrode 6. From FIG. 2 it is apparent that if the filament electrode 6 were to break near the conductive support 8, the longer part connected to the conductive support 7 could fall against the guard 9 and possibly short circuit the voltage applied across the conductive supports 7, 8. Because the conductive support 8 is connected to the guard 9 by the fuse wire 11, any excessive current would necessarily flow through the fuse wire 11, and if the current rating is exceeded the fuse wire 11 will open. Of course, if the filament electrode 6 were to break so that a part of the filament connected to the support 8 were to touch the guard 9, no excess current condition would be created.

Figure 4:
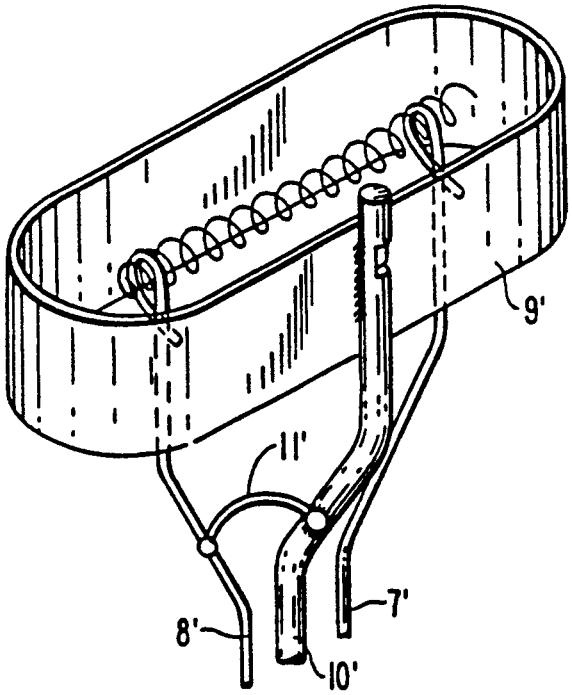
FIG. 4 is an isometric view of another embodiment of the electrode assembly according to the invention.

The isometric view of FIG. 3 clearly shows the spatial arrangement among the conductive electrode supports 7, 8 and the filament electrode 6, the guard 9 and guard support 10, and the fuse wire 11. In another embodiment of the invention shown in FIG. 4 the fuse wire 11 is connected between the electrode support 8' and the guard support 10'.

In operation, the voltage applied to the lamp pins 16, 17 heats the filament electrode 6 to promote thermionic emission of electrons. The potential difference between another electrode at an opposite end of the lamp (not shown) maintains an electrical discharge between the two electrodes. The electrical connection between the guard 9 and the filament electrode 6 established by the conductor 11 increases the effective area of the electrode when it is positively biased, and operating as an anode. This reduces the anode fall and consequently the power required for lamp operation.

Several lamps were made in order to determine what effect, if any, the electrical connection between the electrode 6 and the guard 9 has when the electrode is negatively biased as a cathode. The lamps were standard 40 watt cool white fluorescent lamps. Fourteen lamps were made according to the invention, with the conductor 11 connecting the electrode guard to the electrode support conductor. Additionally, fifteen control lamps without the conductor 11, but otherwise identical to the lamps according to the invention, were made for comparison purposes.

The lamps were operated on a representative commercial two-lamp rapid-start ballast. It was found that a pair of lamps according to the invention operating on the ballast consumed on the average 1.14 watts less than a pair of the control lamps operating on the ballast. To test the statistical significance of the data it was assumed that the average of the differences in power dissipation for each pair of lamps from the mean value followed the normal probably distribution. Based on this assumption, the 95% confidence interval for the difference in power consumption between a pair of lamps according to the invention and a pair of the control lamps was $\pm 1.01$ Watts and it is concluded that the data showing the lower power consumption of the invention is statistically significant. Thus, the lamp according to the invention dissipates about 0.57 watts less than the conventional lamp thereby establishing that whatever effect, if any, the connection between the electrode and the shield has during cathode operation of the electrodes, it is less than the improvement obtained during anode operation.

The connection of the fuse wire 11 to the conductive support and the electrode shield was done by spot welding. The fuse wire was 0.0035 inch diameter stainless steel wire. In order to establish its operability as a fuse, lamps were made with the fuse wire and an internal mechanism for shorting the electrode support to the electrode guard. In each instance with the electrode heater current flowing through the electrode, when the shorting mechanism was operated the fuse opened instantly and terminated the current flowing from the heater winding of the ballast.

However, spot welding the metal wire to the lead-ins and either the electrode guard or the electrode guard support (FIGS. 3, 4) causes assembly problems as compared to prior art lamps not having an electrically connected electrode shield. In a conventional electrode assembly, the lead-ins 7, 8 lie in a common plane, as shown in FIGS. 2 and 3. The electrode guard support 10 bends out of the plane of the lead-ins between the press seal 12 and the side of the electrode guard 9 to which it is attached. The electrode assembly consisting of the stem 3, leads 13, 14, lead-ins 7, 8, electrode guard support 10, the electrode guard 9 and the filament electrode 6 is typically manufactured on one machine. Automating the placement of the wire and the spot welding of the wire 11 in two places has not been practical because the small distance between the lead-ins and the electrode guard support and the small diameter of the wire makes placement of the welding electrodes difficult.

Figure 5:
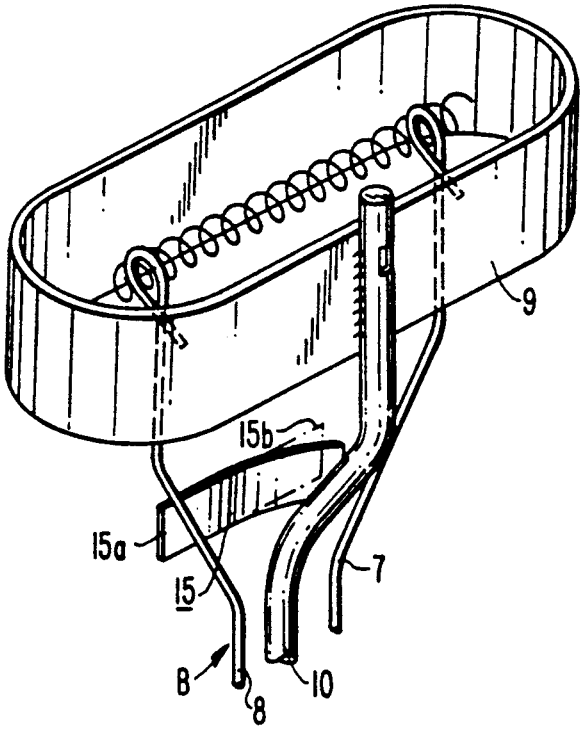
FIG. 5 is an isometric view of the electrode assembly according to the invention using a bimetal strip.

A preferred embodiment has a bimetal strip connecting the electrode guard support 10 and either of the lead-ins 7, 8. As shown in FIG. 5, one end portion **15*a* of the bimetal strip 15 ma be welded to the lead-in 8 with the free end 15*b* disposed adjacent the electrode guard support 10. The position of the free end 15*b* in the inoperative condition of the lamp is shown in broken lines. The bimetal is oriented such that heat from the discharge arc causes the free end 15*b* to bend against and contact the electrode guard support 10. During lamp operation, the free end remains in contact with the electrode guard support and electrically connects the guard 9 to the lead-in 8 because the bimetal is continuously heated by the discharge arc. As shown in FIG. 5, only the lower edge of the bimetal contacts the sloping portion of the electrode guard support 10**. However, this provides sufficient electrical contact.

A preferred bimetal strip has a low expansion side consisting of 36% nickel, 64% iron and a high expansion side of 75% nickel, 22% iron and 13% chrome. According to the preferred embodiment, the distance between the lead-in 8 and the electrode guard support 10 at the location of the bimetal strip is approximately 4 mm. A suitable length for the bimetal is 5 mm. Six 40

Watt cool white lamps were tested having an electrode assembly with the above dimensions. It was found that the free end 15*b* may be spaced up to 2 mm from the electrode guard support to provide reliable contact during lamp operation. With the free end of the bimetal spaced 2 mm from the electrode guard support, the bimetal took an average of 20 seconds to electrically connect the guard support 10 to the lead-in 8 after the heater current was first applied to the filament.

The bimetal is chosen such that heat from the filament electrode due to the application of the heater current during starting of the lamp is not sufficient to cause the free end of the bimetal to contact the guard support. Since any filament failure would normally occur when the heater current is initially applied and before discharge arc is established, the danger of a short-circuit from a portion of the filament falling against the electrode guard is remote since the bimetal would not yet have contacted the guard support.

If the electrode were to fail and a portion of the filament contacted the electrode guard after a discharge arc has been established the danger of ballast damage is very low. If little emitter material remained on the failed filament, the lamp would cease normal operation and only a glow discharge would be maintained. Since heat from the glow discharge is not sufficient to keep the free end of the bimetal against the guard support, electrical contact between the lead-in and the guard support would cease soon after the normal discharge arc extinguished. Alternatively, if enough emitter material remained on the filament connected to the shield, a discharge could still be maintained. While heat from the discharge would maintain the electrical connection between the guard support and bimetal, there would be enough resistance in the electrically connected filament portion such that ballast damage would not occur. To test the integrity of the ballast in such an event, a standard 40 watt cool white lamp was operated on a standard 2-way magnetic ballast with a direct short between the electrode guard and the electrode lead-in. Damage to the ballast did not occur until after 72 days of continuous operation.

The bimetal may also be located closer to the stem where the lead-ins and guard support are parallel, as identified by reference letter "B" in FIG. 5. However, since the distance between the lead-in 8 and the guard support 10 at this location is less than at locations closer to the electrode guard, care must be taken to ensure that the free end of the bimetal does not contact the lead-in 7 as it contacts guard support 10, causing an electrical short between the lead-ins 7 and 8.

Those one of ordinary skill in the art will appreciate that many variations of the electrode assembly which would come within the scope of the invention are possible. For example, instead of connecting the metallic guard support and the electrode lead-in, various configurations of the metallic guard would permit connection of the bimetal between the metallic guard, rather than the guard support, and the lead-in. The bimetal could be welded to an electrode lead-in or the metallic guard to electrically connect the metallic guard during lamp operation.

What is claimed is:

1. In a fluorescent lamp having an electrode, a conductive element for supplying voltage to said electrode, and a metallic guard partially surrounding said electrode for shielding material ejected from said electrode, a discharge arc being maintained in said lamp during lamp operation, the improvement comprising:

a bimetal strip for electrically connecting said conductive element and said metallic guard during lamp operation, said bimetal strip being arranged such that upon starting of said lamp heat from said discharge arc causes said strip to bend and electrically connect said conductive element and said metallic guard for maintaining said metallic guard and said electrode at the same potential during lamp operation irrespective of electrode polarity.

2. In a fluorescent lamp according to claim 1, a conductive guard support for supporting said guard positioned partially surrounding said electrode and said bimetal strip having one end fixed to said conductive element and a free end disposed adjacent said conductive guard support, said bimetal strip being oriented such that said free end contacts said electrode guard support during lamp operation.

3. In a fluorescent lamp according to claim 1, a conductive guard support for supporting said guard positioned partially surrounding said electrode, and said bimetal strip having one end fixed to said guard support and a free end disposed adjacent said conductive, said element strip being bimetal oriented such that said free end contacts said lead-in during lamp operation.

4. In a fluorescent lamp having an electrode, first and second lead-in conductors connected to respective ends of said electrode to allow application of a potential across said electrode and thereby flow a heating current through said electrode, and a metallic guard partially surrounding said electrode, a discharge arc being maintained in said lamp during lamp operation, the improvement comprising:

a bimetal strip for electrically connecting one of said lead-in conductors and said metallic guard during lamp operation, said bimetal strip being arranged such that heat from said discharge arc causes said bimetal strip to bend and electrically connect said one lead-in conductor and metallic guard, during normal lamp operation said bimetal strip electrically connecting and maintaining said metallic guard and said one lead-in conductor at the same potential irrespective of the polarity of the electrode voltage.

5. In a fluorescent lamp according to claim 4, a conductive guard support for supporting said guard positioned partially surrounding said electrode, and said bimetal strip having one end fixed to said first lead-in conductor and a free end, said free end being spaced from said conductive guard support in the inoperative condition of the lamp such that, during normal lamp operation, heat from said discharge arc causes said free end to contact said electrode guard support.

6. In a fluorescent lamp according to claim 4, a conductive guard support for supporting said guard positioned partially surrounding said electrode, and said bimetal strip having one end fixed to said electrode guard support and a free end, said free end being spaced from said one lead-in conductor in the inoperative condition of the lamp such that, during normal lamp operation, said discharge arc causes said free end to contact said one lead-in conductor.

* * * * *